US007467573B1

(12) United States Patent
Lee

(10) Patent No.: US 7,467,573 B1
(45) Date of Patent: Dec. 23, 2008

(54) NAIL HOLDER

(76) Inventor: Han Young Lee, 1032 Summertree Cir., Plano, TX (US) 75025

( * ) Notice: Subject to any disclaimer, the term of this patent is extended or adjusted under 35 U.S.C. 154(b) by 0 days.

(21) Appl. No.: 11/809,753

(22) Filed: Jun. 1, 2007

(51) Int. Cl.
*B25C 3/00* (2006.01)

(52) U.S. Cl. ..... 81/44

(58) Field of Classification Search ..... 81/44; 269/254 CS, 256, 2; 24/522–524; 279/17, 279/23.1, 46.7
See application file for complete search history.

(56) References Cited

U.S. PATENT DOCUMENTS

| | | | | |
|---|---|---|---|---|
| 337,905 | A | 3/1886 | Wheelock | |
| 363,331 | A | 5/1887 | Hammer | |
| 383,516 | A | 5/1888 | De Puy | |
| 612,833 | A | 10/1898 | Dexter | |
| 682,681 | A | 9/1901 | Haas | |
| 1,533,043 | A | 4/1925 | Smith | |
| 1,575,582 | A | 3/1926 | Joy | |
| 1,688,445 | A | 10/1928 | Williams | |
| 1,715,819 | A | 6/1929 | Dealy | |
| 2,420,869 | A | 5/1947 | Davis | |
| 2,648,066 | A | 8/1953 | Ingraham | |
| 2,682,126 | A * | 6/1954 | Shepherd | 269/254 CS |
| 2,716,750 | A | 9/1955 | Biblis | |
| 2,727,325 | A * | 12/1955 | Jurinic | 118/503 |
| 3,060,442 | A | 10/1962 | Tomek | |
| 3,729,035 | A | 4/1973 | Manzanarez | |
| 3,789,895 | A * | 2/1974 | Levinson | 81/44 |
| 4,004,624 | A | 1/1977 | Holstein | |
| 4,029,135 | A | 6/1977 | Searfoss, Jr. | |
| 4,054,237 | A | 10/1977 | Rietveld | |
| 4,079,765 | A | 3/1978 | Hatayan | |
| 4,201,258 | A | 5/1980 | Elmore et al. | |
| 4,221,248 | A | 9/1980 | Rix | |
| 4,367,778 | A | 1/1983 | Bradbury | |
| 4,522,091 | A * | 6/1985 | Toffolon | 82/162 |
| D293,648 | S | 1/1988 | Smirne | |
| 4,784,025 | A | 11/1988 | Peck | |
| 4,874,156 | A * | 10/1989 | Goldzweig | 269/158 |
| 5,996,443 | A | 12/1999 | Gold | |
| 7,100,475 | B1 | 9/2006 | Rufolo, Jr. | |

* cited by examiner

*Primary Examiner*—D. S Meislin
(74) *Attorney, Agent, or Firm*—Mark W. Handley

(57) ABSTRACT

A nail holder (12) has a housing (20) which includes a frame (22) and a guard plate (24). Two grip plates (56, 58) are slidably secured within the housing (20) in opposed relation and have recesses (64) aligned in registration for receiving the shank (16) of a nail (14). Two actuator plates (76, 78) are disposed on opposite sides of the two grip plates (56, 58), spaced apart from respective ones of the grip plates (56, 58) by coil springs (70, 72). Opposite ends of the coil springs (70, 72) fit within recesses (68, 84) formed in respective ones of the grip plates (56, 58) and the actuator plates (76, 78). A user presses the actuator plates (76, 78) lineally inward to press the coil springs (70, 72) against the grip plates (56, 58) and lineally move the grip plates (56, 58) together to squeeze against the shank (16) of the nail (14).

20 Claims, 3 Drawing Sheets

NAIL HOLDER

TECHNICAL FIELD OF THE INVENTION

The present invention relates in general to devices for securing a nail for driving into a receiving member, such as a block of wood, and in particular to a holder for securing a nail in a fixed position for starting the nail while a user's fingers are spaced apart from the nail and protected from impact by a shield.

BACKGROUND OF THE INVENTION

Prior art instruments have been provided for retaining a nail in an upright position for driving the nail into a receiving member, such as a block of wood or a board. Typically, the nail holding instrument is used for starting the nail and not completely driving the nail into the receiving member. That is, the nail is held in position against the receiving member by the prior art instruments, the nail is partially driven into the receiving member and then the nail holding instrument is removed for driving the nail further into a final position in the receiving member. Some prior art nail holding instruments have included elongate handles with an opening at one end for receiving a nail. Others have included tubular members for interiorly receiving nails. Still other prior art nail holding instruments have included pivotally connected lever arms which have recessed openings in opposed registration which are formed for securing on opposite sides of nails, then after the nail is started the pivotally connected levers may be spread apart to move the openings from opposite sides of the nails. Prior art nail holding instruments have also been provided by strips of materials, both rigid metal materials and pliant rubber materials, which have openings formed for receiving nails in support arrangements.

SUMMARY OF THE INVENTION

A nail holder has a housing which includes a frame and a guard plate. The bottom of the frame, a front sidewall of the frame, and the guard plate each have a slot aligned in registration with the other slots for receiving the nail into the housing and for removal of a shank of a nail from the housing. The bottom of the frame and the guard plate each have five spaced apart ribs which extend from one side of the respective guard plate and the frame in parallel for aligning in opposed relation with corresponding ones of the five spaced apart ribs on the other of the guard plate and the bottom of the frame. The five ribs for each of the frame and the guard plate include a central rib, two intermediate ribs and two outer ribs. The central ribs are located adjacent to respective slots and are centrally disposed between respective ones of the two intermediate ribs and the two outer ribs, with the two intermediate ribs each being spaced apart between the central rib and one of the two outer ribs. Two grip plates are slidably secured within the housing in opposed relation between the central rib and respective ones of the intermediate ribs. The grip plates have recesses that align in registration for moving the grip plates together such that the recesses receive and squeeze against the shank of the nail. Two actuator plates are disposed on opposite sides of the two grip plates, fitting between respective ones of the outer ribs and the intermediate ribs, such that the actuator plates are lineally movable toward respective ones of the grip plates. The actuator plates are spaced apart from respective ones of the grip plates by coil springs, with opposite ends of the coil springs fitting within recesses formed in respective ones of the grip plates and the actuator plates. The coil springs apply a first level of force between the actuator plates and respective ones of the grip plates, sufficient for the grip plates to apply pressure and grip the nail in a selected position without a user applying additional force to grip the nail, yet slight force on the nail may be applied to move the nail to a new selected position relative to the nail holder. After the nail is positioned relative to the nail holder and the receiving member, the user applies a second level of force, greater than the first level, by applying finger pressure to the actuator plates which moves the actuator plates against the coil springs and toward one another and the grip plates. The additional force lineally moves the actuator plates inward to press the coil springs against the grip plates, and which lineally move the grip plates toward the nail to squeeze against the shank of the nail with additional force over that applied by the coil springs alone.

DESCRIPTION OF THE DRAWINGS

For a more complete understanding of the present invention and the advantages thereof, reference is now made to the following description taken in conjunction with the accompanying Drawings in which

FIG. 1 is a perspective view of a nail holder for receiving and securing a nail in fixed relation to a surface into which the nail is to be hammered;

FIG. 2 is a sectional view of a nail holder, taken along section line 2-2 of FIG. 1;

FIG. 3 is a sectional view of the nail holder, taken along section line 3-3 of FIG. 2;

FIG. 4 is a sectional view of a nail holder, taken along section line 4-4 of FIG. 1;

FIG. 5 is a top view of a guard plate for the nail holder;

FIG. 6 is a side elevation view of the front of the guard plate for the nail holder;

FIG. 7 is a sectional view of the guard plate, taken along section line 7-7 of FIG. 6;

FIG. 8 is a bottom view of the guard plate; and

FIG. 9 is an exploded view of the nail holder.

DETAILED DESCRIPTION OF THE INVENTION

Figure 1:
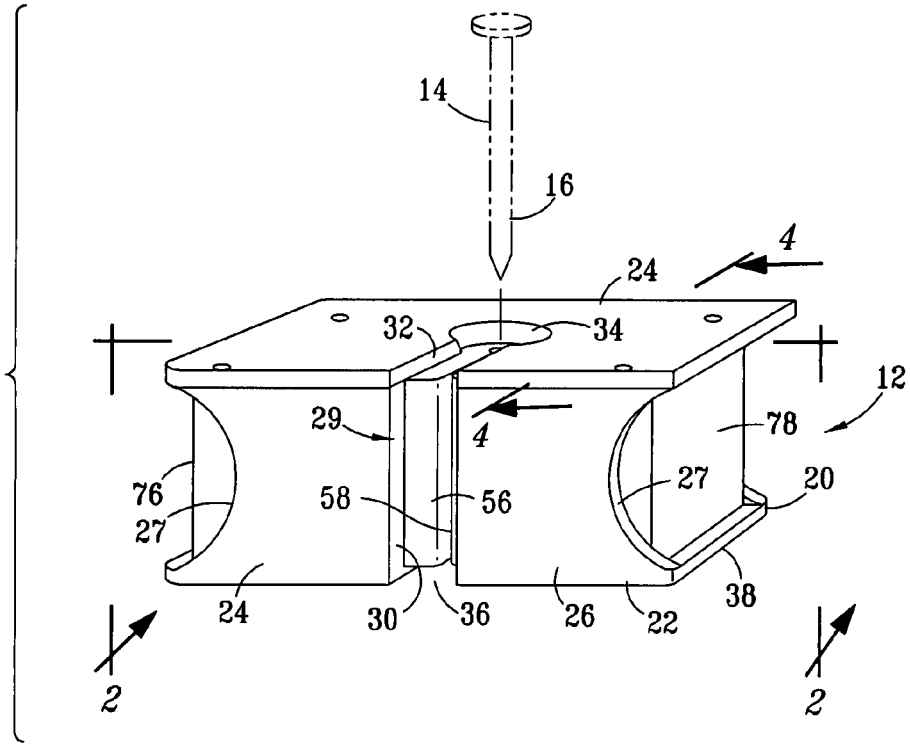
FIGS. 1 through 9 show various aspects for nail holder devices made according to the present invention, as set forth below.

FIG. 1 is perspective view of a nail holder 12 for securing a nail 14 by its shank 16 while the nail 16 is being driven into a receiving member, such as block of wood (not shown). The nail 14 is shown in phantom, prior to being inserted into the nail holder 12. The tip of the nail 14 may be inserted through the top of the nail holder 12, or the shank 16 may be inserted through the side of the nail holder 12. The nail holder 12 has a housing 20 which includes a frame 22 and a guard plate 24. The guard plate 24 provides a shield which covers a user's fingers to prevent the user from being inadvertently struck while driving the nail 14. The frame 22 has a bottom 38, a front side wall 26 and a rear sidewall 28 (shown in FIG. 3). A release gap 29 in the housing 30 is provided by a slot 30 formed into the front sidewall 26, a slot 32 formed into the guard plate 24 and a slot 36 formed into the bottom 38 of the frame 22. The slots 30, 32 and 36 are aligned in a single plane which preferably passes orthogonally through the major planes of the guard plate 24, the sidewall 26 and the bottom 38 to define the release gap 29 for passing the shank 16 of the nail 14 into and out of the housing 20 of the nail holder 12. Inward portions of the slots 32 and 36 have chamfers 34 to bevel the interior ends and countersink the interior edges of the slots 32 and 36 (shown in FIGS. 1 and 3). Actuator plates 76 and 78 are provided for a user to grip to press grip plates 56 and 58 against the shank 14 to retain the nail 16 within the nail holder 12. The outward ends of the sidewalls 26 and 28 have arcuately-shaped peripheral end openings 27 having a half-circle shape, and are provided for receiving a user's fingers as pressure is applied to move the actuator plates 76 and 78 inward into the housing 20.

Figure 2:
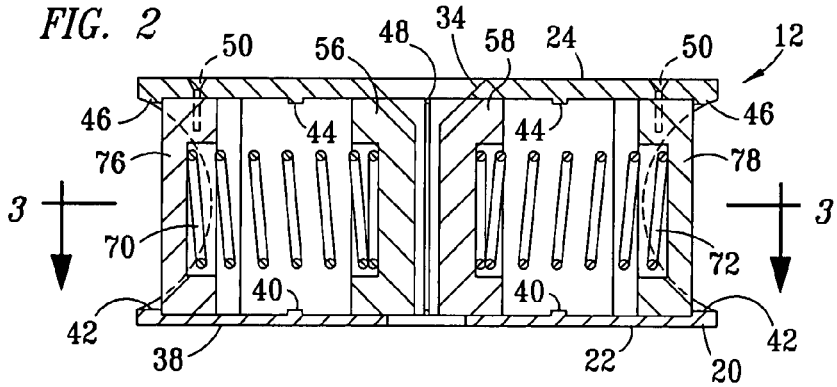
Figure 3:
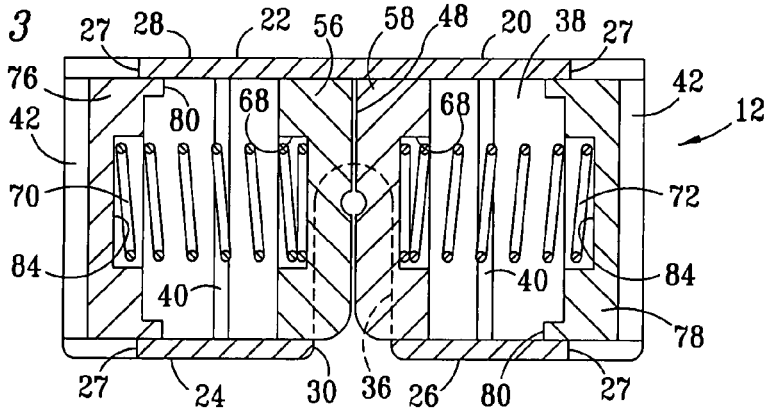
Figure 4:
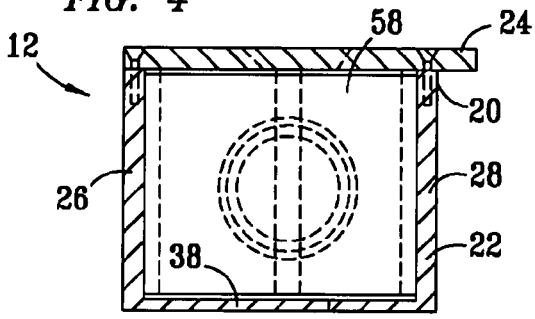

FIGS. 2-4 are sectional views of the nail holder 12, with FIG. 2 taken along section line 2-2 of FIG. 1, FIG. 3 taken along section line 3-3 of FIG. 2, and FIG. 4 taken along section line 4-4 of FIG. 1. The housing 20 generally has a tubular shaped profile of rectangular cross-section, as shown in FIG. 4. The grip plates 56 and 58, and the actuator plates 76 and 78 are preferably rectangular shaped and have peripheral edges which are shaped for conforming to the shape of the tubular, interior profile of the housing 20, such that the peripheral edges of the grip plates 56 and 58 and the actuator plates 76 and 78 fit flush against and slidably engage the interior surfaces of the guard plate 24, the sidewalls 26 and 28, and the bottom 38 of the frame 22. Spring recesses 68 and 84 are formed into the opposed surfaces of mating pairs of the grip plate 56 and the actuator plate 76, and the grip plate 58 and the actuator plate 78, respectively, for receiving respective, opposite ends of resilient bias members 70 and 72. The resilient bias members 70 and 72 are preferably coil springs, provided by wound coils of spring wire. The bias members 70 and 72, the actuator plates 76 and 78, and the grip plates 56 and 58 are preferably configured such that inward pressure applied to the actuator plate 76 will press the grip plate 56 inward toward the grip plate 58 and the release gap 29 defined by the slots 30, 32 and 36, and inward pressure applied to the actuator plate 78 will press the grip plate 58 inward toward the grip plate 56 and the release gap 29. The resilient bias members 70 and 72 will continually apply first level of force by applying spring pressure between respective grip plates 56 and 58 and actuator plates 76 and 78, applying a first level of pressure to press the grip plates 56 and 58 against the shank 16 of the nail 14. At the first level of force, the nail 14 may be positioned relative to the nail holder 12 and the grip plates 56 and 58, with the nail 14 in a selected position relative to the nail holder 12. A second level of force is applied by a user pressing the actuator plates 76 and 78 further inward into the housing 20, to apply additional force through the resilient bias means to the grip plates 56 and 58, respectively, to hold the nail 14 in the selected position while being driven into the receiving member.

Figure 5:
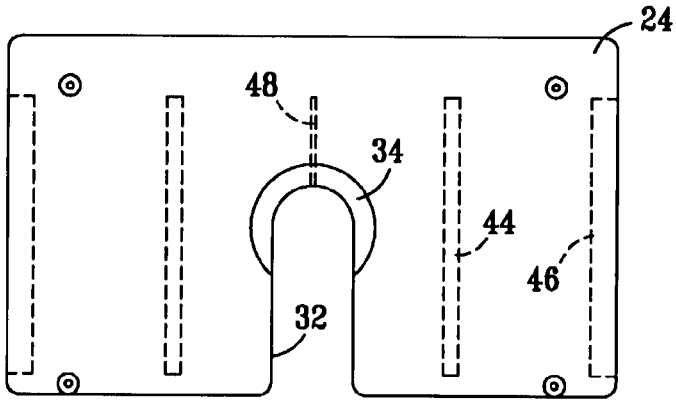
Figure 6:
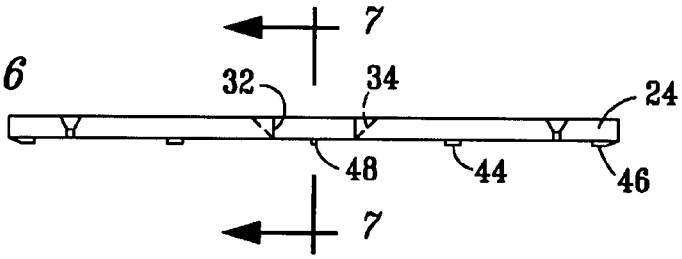
Figure 7:
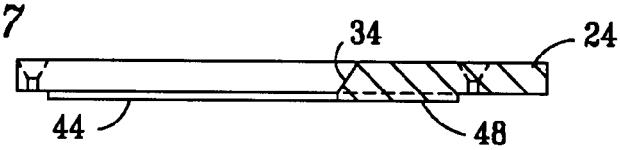
Figure 8:
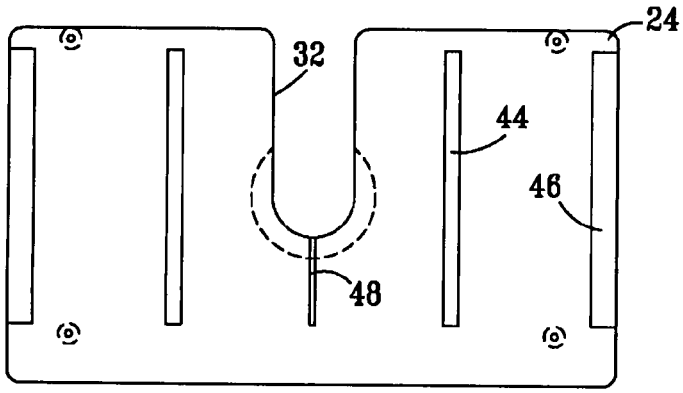

FIGS. 5-8 are views of the guard plate 24, with FIG. 5 being a top view, FIG. 6 being a side elevation view, FIG. 7 being a sectional view taken along section line 7-7 of FIG. 6, and FIG. 8 being a bottom view. FIGS. 5-8 show arrangement of the ribs 44, 46 and 48, which mirror and register with the ribs 40, 42 and 48 of the bottom portion 38 of the frame 22. The ribs 44, 46 and 48 of the interior side of the guard plate 34, and corresponding ribs 44, 46 and 48 of the interior side of the bottom 38 for the frame 22, protrude inward from respective surfaces and are preferably lineally extending protuberant members aligned in parallel to determine the range of travel for respective ones of the grip plates 56 and 58, and the actuator plates 76 and 78. The ribs 48 define central protuberances which inwardly extend from respective ones of the guard plate 24 and the bottom 38 of the frame 22 to provide centrally located stops for limiting movement of the grip plates 56 and 68 inward and into the release gap defined by the slots 30, 32 and 36, and provide a slight nominal spacing between opposed faces of the grip plates 56 and 58. The ribs 40 and 44 define intermediate protuberances which extend inward from respective ones of the bottom 38 of the frame 22 and the guard plate 24 to provide intermediate stops for limiting outward travel of the grip plates 56 and 58 away from the release gap and toward corresponding ones of the actuator plates 56 and 58, and limiting inward travel of the actuator plates 76 and 78 in traveling toward the grip plates 56 and 58, respectively. The ribs 42 and 46 define outer protuberances which extend inward from respective ones of the bottom 38 of the frame 22 and the guard plate 24 to provide outer stops for limiting outward travel of the actuator plates 76 and 78 from between the frame 22 and the grip plate 24.

Figure 9:
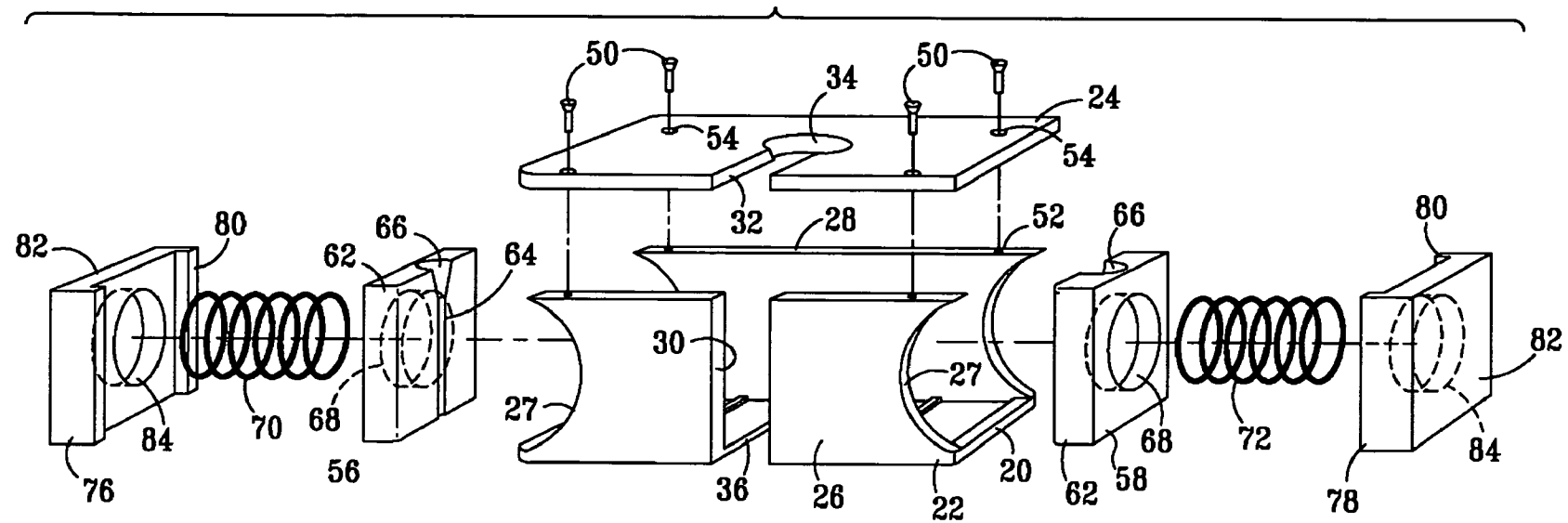

FIG. 9 is an exploded view of the nail holder 12, and shows the grip plates 56 and 58, the actuator plates 56 and 58, the resilient biasing members 70 and 72, and the guard plate 24 removed from the frame 22 defining the housing 20. Fasteners 50 are preferably provided by screws and are used to secure the guard plate 24 to the upper peripheral ends of the sidewalls 26 and 28 of the frame 22. Holes 52 are provided in upper peripheral ends of the side walls 26 and 28 of the frame 22, and the holes 54 extend transverse to the major plane of the guard plate 24 in alignment for registering with the holes 52. The holes 54 are threaded for threadingly receiving the threaded fasteners 50 to secure the guard plate 24 to the upper ends of the frame 22. The grip plates 56 and 58 are disposed in opposed relation with upper ends of the grip plates 56 and 58 slidably extending between the ribs 44 and 48 in the guard plate 24, on opposite sides of slot 32. Lower ends of the grip plates 56 and 58 will be disposed between the ribs 40 and 48 which protrude from the bottom wall 38 of the frame 22, on opposite sides of the slot 36.

The grip plates 56 and 58 are preferably of rectangular shape with peripheral ends 62 which are rounded. Recesses 64 are formed into the opposed faces of respective ones of the grip plates 56 and 58, for receiving and gripping against the shank 16 of the nail 14. The recesses 64 preferably lineally extend and are provided by grooves which are of semicircular cross-section. The upper portions of the recesses 64 have an entrance guide portion 66 which is of a frusto-conical shape for guiding the tip of the shank 16 of the nail 14 within the grooves 64 and pressing the grip plates 56 and 58, such that they will separate for insertion of the nail shank 16 into the housing when the nail 14 is inserted into the housing 20 tip first. The grip plates 56 and 58 will be installed with the recesses 64 and the guide portions 66 in opposed, facing relation. The grip plates 56 and 58 also include the spring recesses 58 facing outward and away from the slots 32 and 36, and toward corresponding ones of the actuator plates 76 and 78. The resilient biasing members 70 and 72 will be mounted in respective ones of the spring recesses 68 for the grip plates 56 and 58, and the spring recesses 84 for the actuator plates 76 and 78. The actuator plates 76 and 78 are disposed in outward portions of the frame 22, and are movably secured between the ribs 40 and 42 which protrude from the bottom wall 38 of the frame 22, and the ribs 44 and 46 which protrude from the grip plate 24. The actuator plates 76 and 78 are preferably of rectangular shape, and each have peripheral edges 82 from which two guide flanges 80 extend on opposite sides of the major plane, or rectangular shaped face, of the actuator plates 76 and 78. The guide flanges 80 are preferably provided for lineally extending ribs which aid in maintaining orthogonal alignment between the interior surfaces of guide plate 24, the sidewalls 26 and 28, and the bottom 38 of the frame 22. Guide flanges similar to the guide flanges 80 may also optionally be provided on the grip plates 56 and 58, preferably extending toward respective ones of the corresponding actuator plates 76 and 78, but are not provided in the preferred embodiment. The actuator plates 76 and 78 have inward facing spring recesses 84 and an outer flat surface 82.

The nail holder 12 will be used for aligning a nail 14 for driving, by a user placing the shank 16 of the nail 14 within the nail holder 12. The tip of the nail 14 may slide directly between the grip plates 56 and 58 by passing directly into the inward terminal end of the slot 32, between the grip plates 56 and 58, and outward through the inward terminal end of the slot 36. In the alternative, the shank 16 of the nail 14 may be passed through slot 30 in the sidewall 26 and move inward between the grip plates 56 and 58, pushing the grip plates 56 and 58 outward against the force of the resilient bias members 79 and 72. The resilient bias members will then press the grip plates 56 and 58 against the shank 15 of the nail 14 with a first level of force, or first pressure, to retain the nail 14 within the nail holder 12 for positioning. Then, users may use their fingers to press the actuator plates 76 and 78 inward, toward the nail 14 and the grip plates 56 and 58. Pressing the actuator plates 76 and 78 together towards the central portion of the nail holder 12 applies a second level of force, or second pressure, to press the grip plates 56 and 58 against the shank 16 of the nail 14, while the nail is held in position for driving into a receiving member. When applying the second level of force, users may place their fingers beneath the guard plate 24, such as to avoid the danger of the user inadvertently striking their fingers rather than the head of the nail. The nail 14 may then be driven such that it is started into the receiving member until the nail 14 is self supporting. Then, the nail 14 may be removed from within the nail holder 12 by passing the shank 16 of the nail 14 from between the two grip plates 56 and 58, in a direction moving outward from the interior portions of the slots 32 and 36, and through the slot 30 in the sidewall 26 of the frame 22.

Thus the advantages of this invention provide a nail holder for retaining a shank of a nail while being driven into a receiving member, while reducing the risk of injury by a person inadvertently striking themselves rather than the head of the nail. The nail holder grips the shank of the nail with two levels of force. A first level of force is applied by resilient biasing members provided within the nail holder, without application of force by a user, which is sufficient for selectively positioning the nail relative to the nail holder and the nail holder relative to a receiving member. Then, after the nail is placed in a selected position, a second level of force is applied by the user gripping actuator plates and pressing inward to securely grip the nail within the nail holder for driving into the receiving member. The user's fingers are underneath a guard plate when applying the second level of force and driving the nail into the receiving member.

Although the preferred embodiment has been described in detail, it should be understood that various changes, substitutions and alterations can be made therein without departing from the spirit and scope of the invention as defined by the appended claims.

What is claimed is:

1. A nail holder for securing a nail for driving, comprising:

a housing which includes a frame and a guard plate;

first and second grip plates, each having recesses formed into sides of respective ones of said grip plates for receiving at least a portion of a shank of the nail, wherein said grip plates are slidably secured within said housing in opposed relation with respective ones of said recesses in registration for lineally moving said grip plates together to press the shank of the nail between said recesses in said sides of said grip plates;

two actuator plates disposed on opposite sides of said grip plates, spaced apart from respective ones of said grip plates;

two resilient biasing members, one of said biasing members disposed between said first grip plate and a first one of said actuator plates, and the other of said biasing members disposed between said second grip plate and a second one of said actuator plates; and wherein said actuator plates are lineally movable into said housing and toward the other of said actuator plates to press said resilient biasing members against respective ones of said grip plates, which lineally moves said grip plates together to squeeze against the shank of the nail.

2. The nail holder according to claim 1, further comprising said housing having protuberances which extend in registration with corresponding ones of said protuberances for fitting said grip plates and said actuator plates between and determining a range of travel for lineal movement of said grip plates and said actuator plates.

3. The nail holder according to claim 2, wherein said protuberances are ribs which extend in parallel, transverse to said lineal movement of said grip plates and said actuator plates.

4. The nail holder according to claim 3, further comprising said housing have a first slot and a second slot which are aligned in parallel for receiving the shank of the nail into said housing, between said grip plates and in registration with said recesses in said grip plates.

5. The nail holder according to claim 1, wherein said slots extend in parallel to said ribs.

6. The nail holder according to claim 1, wherein said resilient biasing members comprise coil springs.

7. The nail holder according to claim 6, wherein first spring recesses are formed into each of said first and second grip plates, on opposite sides of said grip plates from said recesses for receiving the shank of the nail, and second spring recesses are formed into respective sides of said actuator plates for registering with said first spring recesses formed into said grip plates for receiving opposite ends of said coils springs into respective ones of said first and second spring recesses.

8. A nail holder for securing a nail for driving, comprising:

a housing which includes a frame and a guard plate, said housing having inner protuberances and outer protuberances, with said inner protuberances extending in registration with corresponding ones of said inner protuberances and said outer protuberances extending in registration with corresponding ones of said outer protuberances;

first and second grip plates, wherein said grip plates are slidably secured within said housing in opposed relation between said inner protuberances, such that said grip plates are lineally moveable for pressing together to press the shank of the nail between said grip plates;

two actuator plates disposed on opposite sides of said grip plates, spaced apart from respective ones of said grip plates and disposed between respective ones of said outer protuberances and said inner protuberances, such that said actuator plates are moveable between said respective ones of said outer protuberances and said inner protuberances;

two resilient biasing members, one of said biasing members disposed between said first grip plate and a first one of said actuator plates, and the other of said biasing members disposed between said second grip plate and a second one of said actuator plates; and wherein said actuator plates are lineally movable into said housing and toward the other of said actuator plates to press said resilient biasing members against respective ones of said grip plates, which lineally moves said grip plates together to squeeze the shank of the nail therebetween.

9. The nail holder according to claim 8, further comprising said housing have a first slot and a second slot which are aligned in parallel for receiving the shank of the nail into said housing, between said grip plates and in registration with said recesses in said grip plates.

10. The nail holder according to claim 9, wherein said protuberances are ribs which extend in parallel, transverse to said lineal movement of said grip plates and said actuator plates.

11. The nail holder according to claim 10, wherein said slots extend in parallel to said ribs.

12. The nail holder according to claim 8, wherein recesses are formed into said grip plates, on sides of said grip plate for registering with a corresponding one of said recesses in an opposed grip plate for receiving the shank of the nail therebetween.

13. The nail holder according to claim 12, wherein said resilient biasing members comprise coil springs.

14. The nail holder according to claim 13, wherein first spring recesses are formed into each of said first and second grip plates, on opposite sides of said grip plates from said recesses for receiving the shank of the nail, and second spring recesses are formed into respective sides of said actuator plates for registering with said first spring recesses formed into said grip plates for receiving opposite ends of said coils springs into respective ones of said first and second spring recesses.

15. A nail holder for securing a nail in alignment for driving into an adjacent member, the nail holder comprising:

a housing having a frame and a guard plate, with said frame and said guard plate each have a slot aligned in registration with said slot of said other of said frame and said guard plate for receiving a shank of the nail into said housing;

said frame and said guard plate each having five spaced apart ribs which extend from one side of said respective guard plate and said frame in parallel for aligning in opposed relation with corresponding ones of said five spaced apart ribs on said other of said guard plate and said frame, wherein said five ribs for each of said frame and said guard plate include a central rib, two intermediate ribs and two outer ribs;

wherein said central ribs are located adjacent to a respective one of said slots and are centrally disposed between respective ones of said intermediate ribs and said outer ribs, with said intermediate ribs each being spaced apart between respective ones of said central ribs and said two outer ribs;

two grip plates slidably secured within said housing in opposed relation between said central rib and respective ones of said intermediate ribs, with recesses aligned in registration for lineally moving said grip plates to press said recesses against the shank of the nail when the nail is disposed in said slots in said housing;

actuator plates disposed on opposite sides of said two grip plates, fitting between respective ones of said outer ribs and said intermediate ribs, such that said actuator plates are lineally movable toward respective ones of said grip plates; and resilient biasing members fitting between said actuator plates and said grip plates, wherein said actuator plates are spaced apart from respective ones of said grip plates by said resilient biasing members, such that lineally moving said actuator plates together presses said resilient biasing members against said grip plates to lineally move said grip plates together to squeeze against the shank of the nail.

16. The nail holder according to claim 15, wherein said resilient biasing members comprise coil springs.

17. The nail holder according to claim 16, wherein first spring recesses are formed into each of said first and second grip plates, on opposite sides of said grip plates from said recesses for receiving the shank of the nail, and second spring recesses are formed into respective sides of said actuator plates for registering with said first spring recesses formed into said grip plates for receiving opposite ends of said coils springs into respective ones of said first and second spring recesses.

18. The nail holder according to claim 17, wherein said coil springs press said grip plates against the shank of the nail when said actuator plates are disposed in outward positions.

19. The nail holder according to claim 18, wherein said slots for receiving the shank of the nail have inward ends which are countersunk and said recesses in said grip plates have ends which are countersunk to provide a recess guide for receiving an end of the nail.

20. The nail holder according to claim 19, wherein said actuator plates have flanges on sides thereof for slidably engaging sidewalls of said housing.

* * * * *